US005553365A

United States Patent [19]

Catallo

[11] Patent Number: 5,553,365

[45] Date of Patent: Sep. 10, 1996

[54] MEANS FOR CONTROLLING DEFLECTION IN A TWO-ROLL FABRIC SHRINKER

[76] Inventor: Frank Catallo, 75 Channel Dr., Port Washington, N.Y. 11050

[21] Appl. No.: 350,340

[22] Filed: Dec. 6, 1994

[51] Int. Cl.[6] ..... D06C 21/00

[52] U.S. Cl. ..... 26/18.6

[58] Field of Search ..... 26/18.5, 18.6; 28/103, 155; 162/111, 280, 281, 361

[56] References Cited

U.S. PATENT DOCUMENTS

| | | | |
|---|---|---|---|
| 3,973,303 | 8/1976 | Diggle, Jr. | 26/18.6 |
| 4,112,559 | 9/1978 | Troope et al. | 26/18.6 |
| 4,142,278 | 3/1979 | Walton et al. | 26/18.6 |
| 4,363,161 | 12/1982 | Catallo | 26/18.6 |
| 5,016,329 | 5/1991 | Milligan et al. | 26/18.6 |
| 5,117,540 | 6/1992 | Walton et al. | 26/18.6 |

*Primary Examiner*—Amy B. Vanatta
*Attorney, Agent, or Firm*—Leo Fornero

[57] ABSTRACT

An improved apparatus for the compressive shrinking of fibrous web materials is disclosed. The apparatus uses a system of moving rolls of different speeds cooperating with a confining member to form a stuffing chamber wherein a web material moves in a passageway where it is compacted. The addition of means for moving the rolls to provide a substantially uniform dimension to the passageway facilitates the compaction of the web material.

4 Claims, 2 Drawing Sheets

MEANS FOR CONTROLLING DEFLECTION IN A TWO-ROLL FABRIC SHRINKER

FIELD OF INVENTION

The invention relates to an apparatus for the compaction of a fibrous web material wherein pre-shrinkage properties are imparted to the fibrous web material.

BACKGROUND OF THE INVENTION

A number of different methods have been proposed to effect a compressive force on fibrous thread interlaced web material in order to impart pre-shrinkage properties to the material. One such method and apparatus is disclosed in U.S. Pat. No. 4,447,938 wherein a fibrous web material is forced into a stuffing chamber where the stuffing chamber is formed by a confining means having an apex like extension and two movable surfaces with the apex or extension extending in part between the surfaces.

A passageway is formed between one side of the extension and one movable surface and the passageway continues between the other movable surface and the other side of the apex.

The fibrous web material is disposed to run through the passageway as it is compacted. The two movable surfaces may be positioned close to each other to decrease the size of the passageway and stuffing chamber so that the material forced into the chamber is caused to contact and turn on the apex of the confining means. This results in a kneading or working action being imparted to the fibers or yarns forming the material which assists in the repositioning of the fibers while the material is in a compressed state.

Where even a greater reduction of shrinkage potential is desired an impact blade may be positioned between the first and second movable surfaces to extend into the stuffing chamber to prevent movement of the web material into the space between the movable surfaces caused by compressive forces exerted on the fabric material.

When the two surfaces are positioned further apart to enlarge the passageways and stuffing chamber, the material in the stuffing chamber will be slightly spaced from the apex such that both sides of the web material will be spaced from the wails of the stuffing chamber a slight amount. This allows easy repositioning of stitches when the material is subjected to a heat or steam treatment in order to puff or swell the individual yarns.

If an approach could be developed to treat web materials that were slit open and then presented to the unit in a single layer benefits in operation would be forthcoming to the manufacturer - also the machine could be used to compact a wider variety of web materials.

However when larger diameter movable surfaces were used to assure roll straightness this did not permit the formation of passageways having an optimum configuration to achieve maximum compaction and constant fabric material treatment.

Also at times when these larger rolls were used there developed difficulty in the movement of the fabric material through the passageways particularly if there were slight variations in fabric thickness or uniformity. Use of smaller rolls as movable surfaces were more forgiving but at times deflection of the rolls occurred to change the dimensions of the passageways which interfered with material compaction. This deflection was most pronounced when the face of the roll is greater then about 10 times the roll diameter. It will be clear that use of smaller sized rolls will enable a producer to manufacture a machine that is less expensive to build and easier to maintain. However due to the roll deflection larger rolls were required with concomitant alteration in passageway size along with changes in the size of the stuffing box.

It will be understood that the invention contemplated herein will function equally well on an arrangement wherein the fabric flows into the chamber formed by a confining means and a first movable surface and from where the fabric moves down and around the apex of the confining means and then upwardly on the other side of the apex or extension and around the other movable surface. The concept will also work as well on a similar arrangement where the fabric is moved through the stuffing chamber and downwardly around the second movable surface. The invention disclosed herein permits use of the smaller rolls and allows the user to obtain the resultant benefits.

It is therefore an object of my invention to provide an apparatus which is useful to shrink fibrous web materials in a more efficient manner and accomplish this pre-shrinking on a machine that is less expensive to manufacture and easier to maintain.

It is a further object of my invention to provide for an apparatus that is more versatile so that a large variety of fibrous webs may be compressively shrunk to more demanding conditions.

GENERAL DESCRIPTION OF THE INVENTION

Broadly the apparatus according to my invention comprises forcing a fibrous web material, for example a fibrous thread interlaced web material into a stuffing chamber where the stuffing chamber is formed by a confining means having an apex and two movable surfaces with the apex extending in part between the surfaces. One of the surfaces is moved with respect to the confining means in a direction towards the stuffing chamber at a particular speed in order to feed a web of material into the chamber. The second movable surface moves in a direction substantially opposite to the direction of movement of the first surface and at a slower speed to move compressed material out of the stuffing chamber. Since both movable surfaces move in the same direction as the web material they do not impart any scuffing action onto the material. The two movable surfaces may be positioned close to each other to decrease the size of the stuffing chamber such that the material forced into the chamber is caused to contact and to turn about the apex of the confining means.

Where even a greater reduction in shrinkage potential is desired, an impact blade may be positioned between the first and second movable surfaces to extend into the stuffing chamber to prevent movement of fabric into the space between the movable surfaces caused by the compressive forces created on the fabric. The space between these movable surfaces and the apex, as will be seen form the drawings, forms passageways for the fabric material and it is important that such space be of consistent and substantially the same dimension through out. I have found that it is particularly beneficial to construct a machine that may be used to compact webs of all types for the versatility it provides; namely, this results in manufacturing savings and efficiency in operation.

In order to achieve this objective I have incorporated rolls as the movable surfaces whose face or length dimension is more than about ten times the dimension of the roll diameter. To overcome the problem of deflection-normally caused by the compressive forces imparted through the rolls to the fabric to shrink same-I have incorporated a means for controlling deflection which functions to keep the surfaces straight and the dimensions of the passageways substantially constant. Thereby providing an apparatus having the capability to process a wide variety of fabrics.

More particularly in order to achieve the desired results a lever like member is formed on one of the rolls and manipulated as desired by a shaft which is moved through the regulation of a pneumatic cylinder to thereby move the rolls away or towards one another as desired. The rolls are supported at the ends by bearings and pillow block bearings fixed to a frame which supports the apparatus. The rolls are maintained in a desired location by positioning a wedge like member between bearings located at the ends of the rolls.

BEST MODE FOR CARRYING OUT THE INVENTION

Figure 1:
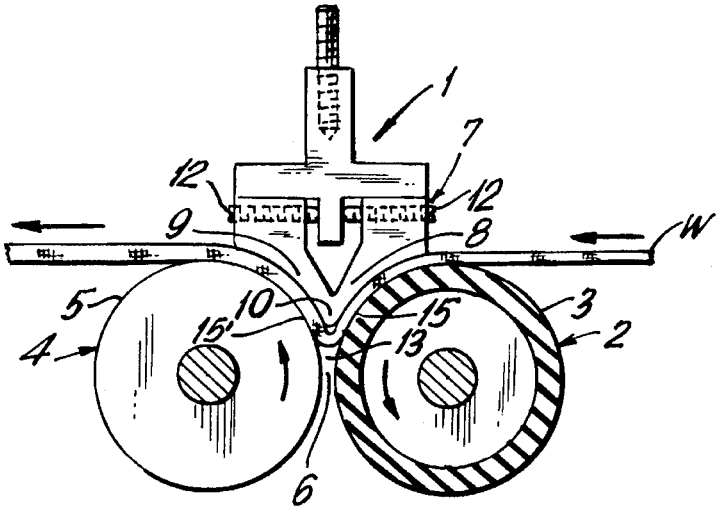
FIG. 1 is a diagrammatical side section of an apparatus contemplated herein.

Referring to FIG. 1, there is shown an apparatus 1 for the compressive treatment of a web W of fibrous material, for example a fibrous thread interlaced web material, which is fed by roll 2 having a first uninterrupted surface 3 on its outer periphery and which rotates in the direction of the arrow indicated. A roll 4 which has a second uninterrupted surface 5 thereon is positioned adjacent and spaced from the roll 2. Roll 4 rotates in the same direction as roll 2 such that the surfaces 3 and 5 move in opposite peripheral directions at the roll nip area 6.

Figure 4:
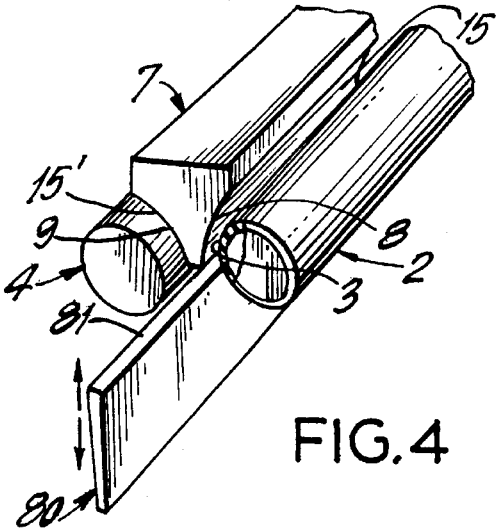
FIG. 4 is a diagrammatical perspective view of the apparatus including the impact blade of the type illustrated in FIG. 3.

A confining means 7 in the form of a gull shaped member having wings 8 and 9 which join together at the apex 10 is positioned above the rolls. As shown, apex 10 of the confining means has a smooth arcuate surface and extends between the surfaces 3 and 5 on the rolls and is directed towards the nip area. As may best be seen in FIG. 4 passageways 15 and 15' are formed between the wings 8 and 9 of the confining means and the rolls 2 and 4. Webs of material W move through these passageways as is shown in the drawings. The confining means also includes adjustment means 12 in the form of screws such that the angle between the wings at the apex may be varied to further control the spacing of the passageways between the wings and the surfaces of the rolls.

Figure 5:
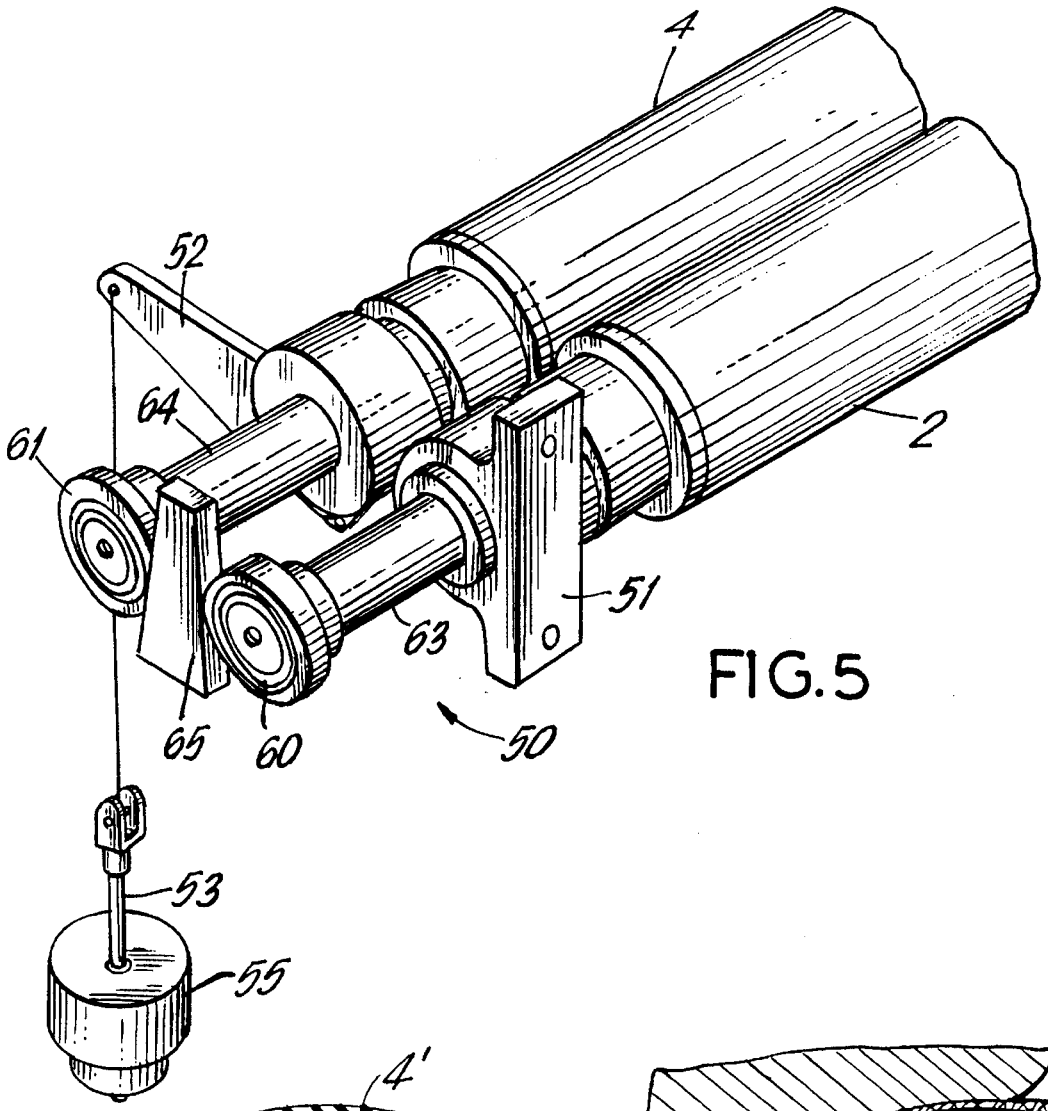
FIG. 5 is a partial diagrammatical perspective view of a portion of the apparatus showing the portion of the apparatus for adjusting the rolls to maintain the passageways of substantially the same dimension.

Further control of this spacing is accomplished by providing in FIG. 5 a means designated 50 for adjusting deflection of the rolls to thereby maintain a desired size to passageways 15 to 15' to optimize the compaction of the fabric web material. The means for adjusting the deflection comprises bearings 51 in the form of pillow block bearings mounted at both ends of the roll 2 and lever bearings 52 mounted at both ends of the roll 4. The bearings 51 are mounted to a frame not shown in the usual fashion.

By providing for the pivoting of the bearings 52 you allow for the movement of the rolls towards or away from one another and the changing of the size of the passageways 15 and 15'. This is accomplished by moving shaft 53 which is connected to lever bearing 52 at one end and a pneumatic cylinder 55 at the other end. Adjustment of the cylinder 55 causes movement of the lever 52 to move the rolls. Roller bearings 60 and 61 mounted on shafts 63 and 64 have a wedge like member 65 disposed therebetween as can be seen in FIG. 5.

As shown, the material W prior to compression is fed by roll 2 through the space between the roll 2 and wing 8 into the stuffing chamber 13. Roll 4 rotates at a slower speed than roll 2 so that it imparts a retarding force on the web of the material W.

Figure 2:
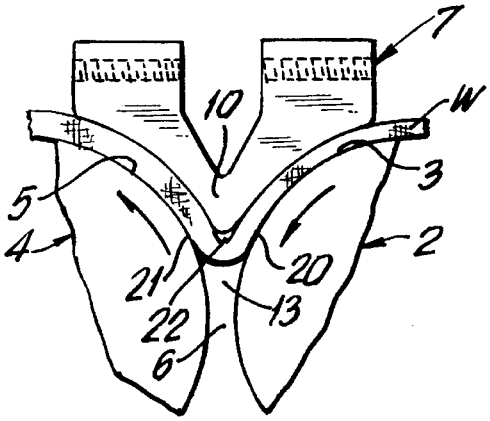
FIG. 2 is an enlarged view of a portion of FIG. 1 illustrating spacing of material from the sides of the stuffing chamber and having variations in such spacing.
Figure 3:
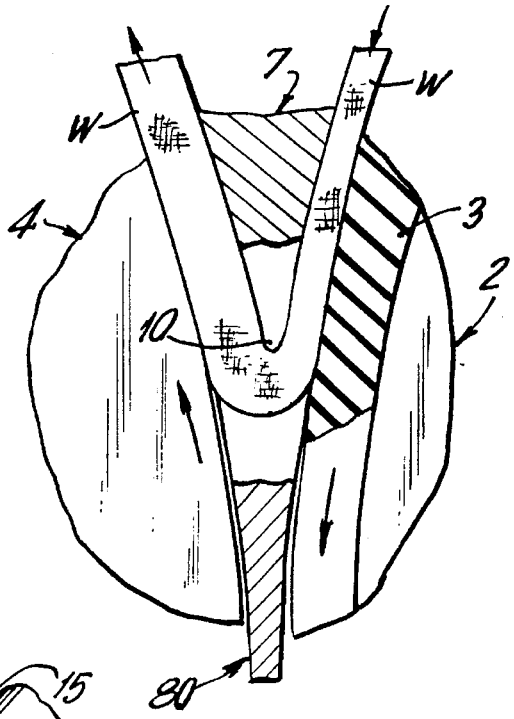
FIG. 3 is an enlarged view of a portion of the apparatus including an impact blade.

This results in longitudinal compressive forces being exerted on the web of material from approximately the point 20 as shown in FIG. 2 near where the web enters the stuffing chamber and the point 21 where the web exits the stuffing chamber. As shown, the web W is turned around the apex 10 such that space 22 is formed between the upper side of the web and apex. Further there is also a space on the bottom side of the web opposite the space 22 so that a portion of the web is free from contact with any structure and to this extent is self-supporting. This self-supporting feature allows free sliding movement of the fibers making up the material throughout the entire thickness of the material including both the top and bottom sides of the material resulting in a complete stress release of the fibers while the material is in a compressed state.

Figure 6:
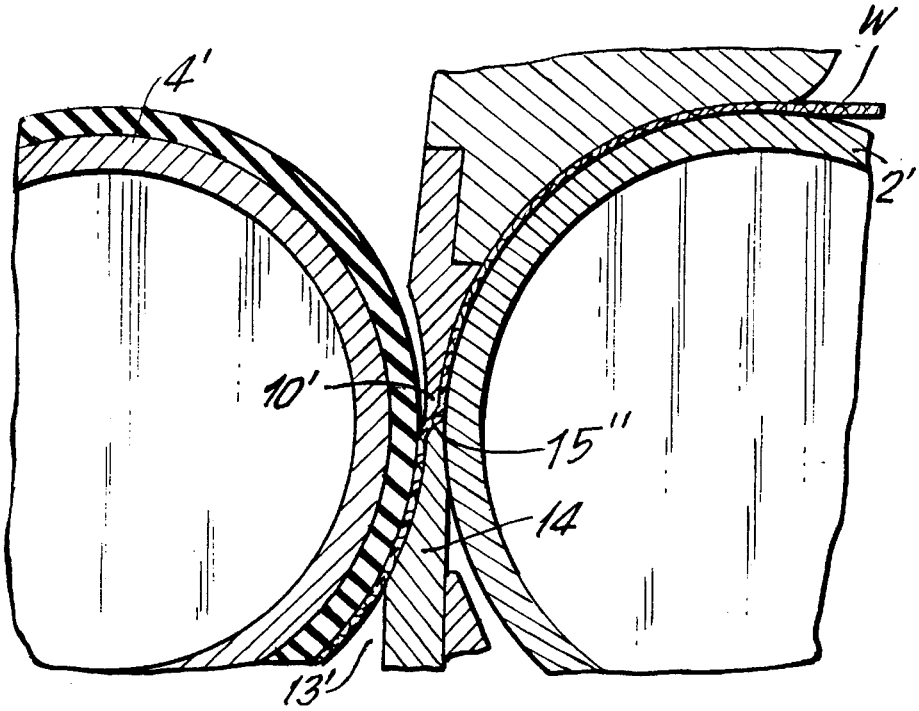
FIG. 6 is a partially enlarged side view of another form of apparatus which may benefit from the invention contemplated herein.

In FIG. 6 a similar type of compaction apparatus is shown as that described in FIG. 1 rolls designated 2' and 4' having movable surfaces are shown and function to move the fabric W into and out of a stuffing chamber 13'. The chamber is formed between the movable rolls 2' and 4' and a confining means including an extension or apex 10' which cooperates with a bottom extension 14 to form the chamber 15". From chamber 15" fabric W is moved out by the action of the roll 4'.

The effects of deflection that the compressive shrinking forces cause may also be evident in the type of apparatus shown in FIG. 6 and deflection reducing means as shown in FIG. 5 and described herein are obviously beneficial as outlined above.

As will be clear from the foregoing an advantage of the apparatus disclosed herein is that compaction of a wider variety of fabrics is possible by being able to control the size of the space or passageway formed by the wings of the confining means and the rolls of the unit. This control is of particular benefit when it is desired to gain from the advantages provided by a smaller diameter type roll. Such rolls have a diameter that is less than 10 times the length of the face of the roll.

To increase the shrinkage capacity of the apparatus contemplated herein an impact blade assembly designated 80 is shown in schematic form and the blade 81 is inserted to cooperate with the confining means to facilitate the flow of web material or fabric into and out of the stuffing chamber. The impact blade functions to guide the fabric as it flows in its intended path.

I claim:

1. An apparatus for the compressive treatment of a fibrous web material where the apparatus comprises a first movable surface having opposite end portions, means for moving said first movable surface at a first rate of speed, a second movable surface spaced from said first movable surface, means for moving said second movable surface at a second rate of speed, a confining means having two opposite wing like surfaces spaced from said first and second movable surfaces and cooperating therewith to form a stuffing chamber into which fibrous web material is adapted to be moved by said first movable surface and from which said fibrous web material is adapted to be moved by said second movable surface, said stuffing chamber also being formed between one of said movable surfaces and one of said wing like surfaces and the other movable surface and the opposite wing like surface to define a passageway for said web material, and means connected to each end of one of said movable surfaces to adjust said movable surfaces to a predetermined position so that the passageways of said stuffing chamber are adjusted to substantially the same dimension when deflection of a movable surface occurs causing a distortion in the passageway dimension.

2. An apparatus according to claim 1 wherein said movable surfaces are each mounted on a shaft and each of said shafts have rolls mounted on each of the ends thereof and said means to adjust said movable surfaces comprising a wedge member for said apparatus disposed to abut each of said rolls so that the passageway formed between said confining means and one of the movable surfaces and the confining means and the other of said movable surfaces is of substantially the same dimension, and including means for moving said wedge member relative to said rolls.

3. An apparatus according to claim 1 wherein said means for moving said wedge member comprises means connected to the rolls to move the rolls towards or away from each other to thereby permit relocation of the wedge member to a predetermined position in abutting relation with said rolls in order to maintain a passageway having substantially the same dimension.

4. An apparatus according to claim 3 including an impact blade extending towards said confining means.

* * * * *